US006607026B1

(12) United States Patent
Naji et al.

(10) Patent No.: US 6,607,026 B1
(45) Date of Patent: Aug. 19, 2003

(54) HEATING, VENTILATION AND/OR AIR-CONDITIONING DEVICE INCLUDING A THERMAL LOOP EQUIPPED WITH AN EVAPORATOR

(75) Inventors: Said Naji, Elancourt (FR); Laurent Legot, Paris (FR)

(73) Assignee: Valeo Climatisation (FR)

( * ) Notice: Subject to any disclaimer, the term of this patent is extended or adjusted under 35 U.S.C. 154(b) by 0 days.

(21) Appl. No.: 09/474,708

(22) Filed: Dec. 29, 1999

(30) Foreign Application Priority Data

Dec. 30, 1998 (FR) ..... 98 16636

(51) Int. Cl.[7] ..... F28D 1/03

(52) U.S. Cl. ..... 165/153; 165/135; 165/176; 165/906

(58) Field of Search ..... 165/153, 135, 165/906, 176

(56) References Cited

U.S. PATENT DOCUMENTS 3,976,128 A * 8/1976 Patel et al. ..... 165/153
4,274,482 A * 6/1981 Sonoda ..... 165/153
5,620,046 A 4/1997 Waldhelm et al.
5,645,126 A * 7/1997 Nishishita et al. ..... 165/153
5,881,805 A 3/1999 Inoue et al.

FOREIGN PATENT DOCUMENTS

| | | | |
|---|---|---|---|
| EP | 0 497 339 | 8/1992 | |
| JP | 61-295492 | * 12/1986 | ..... 165/153 |
| JP | 2-68500 | * 3/1990 | ..... 165/153 |
| JP | 4-356690 | * 12/1992 | ..... 165/906 |
| WO | 11399 | 6/1993 | |

* cited by examiner

*Primary Examiner*—Leonard Leo
(74) *Attorney, Agent, or Firm*—Morgan & Finnegan, LLP

(57) ABSTRACT

A heat exchanger for a heating, ventilation and/or air-conditioning device including a thermal loop equipped with a heat exchanger, is characterized in that at least one of the first and second longitudinal ends (92) of at least one partition plate (20) and/or of at least one end plate (9) is coupled to at least one of the first and second ends of a said orientation plate (2, 20) by means of a damper element (94, 95).

16 Claims, 3 Drawing Sheets

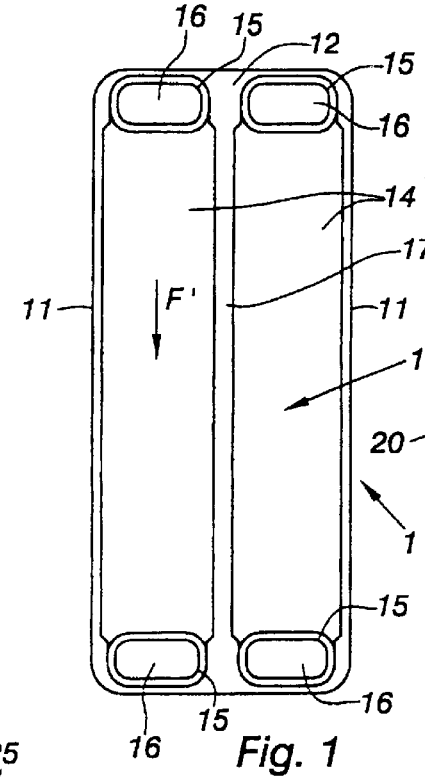
Fig. 1
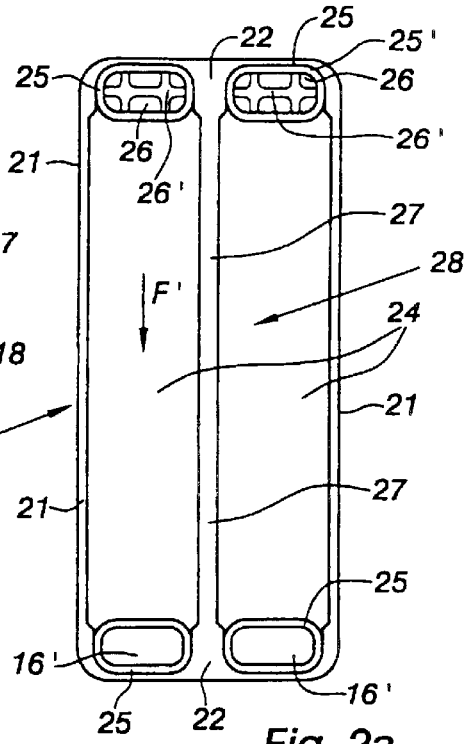
Fig. 2a
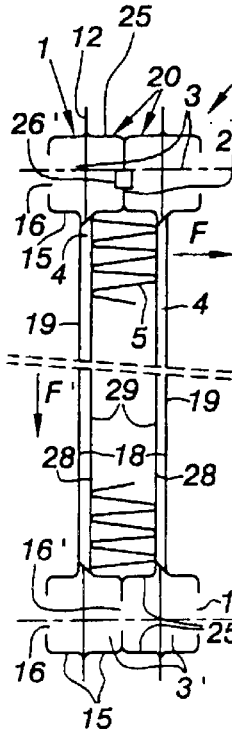
Fig. 2b
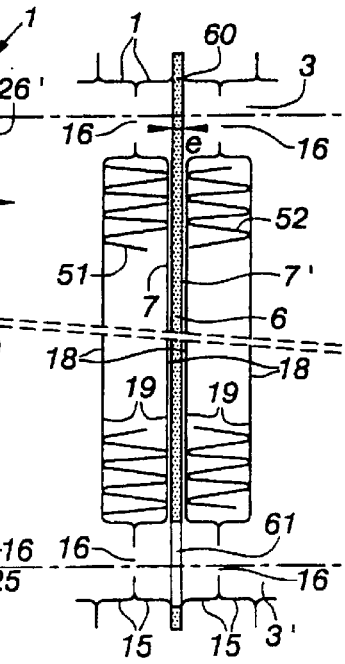
Fig. 3a
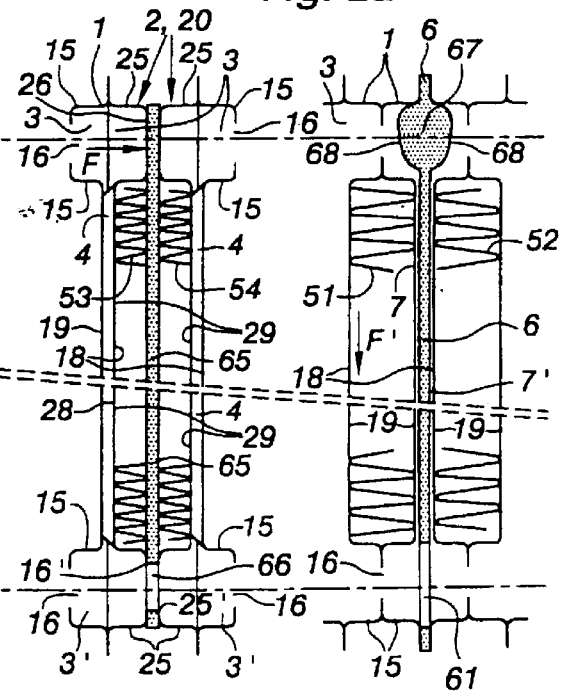
Fig. 3b
Fig. 3c

HEATING, VENTILATION AND/OR AIR-CONDITIONING DEVICE INCLUDING A THERMAL LOOP EQUIPPED WITH AN EVAPORATOR

FIELD OF THE INVENTION

The present invention relates to a heating, ventilation and/or air-conditioning device.

BACKGROUND OF THE INVENTION

Heating, ventilating and/or air conditioning devices are known having a thermal loop equipped with an evaporator, said evaporator consisting of a stack of plates having opposite first and second longitudinal ends some of which have separation elements intended to divert a flow of cooling liquid circulating in an axial direction of the evaporator so as to direct it to a channel region in which it travels from one said end to the other in a longitudinal direction of the plates.

The partition plates and, more generally, the chamber passages in evaporators with brazed plates are designed to meet the requirements of mechanical strength and to promote a balanced distribution of the cooling fluid in the various channels. Likewise, the parts of the coolant ducts close to the inlet and outlet manifolds meet the same requirements, while also seeking to promote turbulence of the flow in order to intensify the heat exchanges.

In its current design, which makes it possible to reconcile mechanical strength and high level of heat exchange, the geometry is a source of turbulence and of breakaway flow of the cooling fluid which are likely to generate noise emission causing discomfort for the user.

The present invention proposes to reduce the flow noise which is generated on the outside by the evaporator.

To this end the invention proposes to limit the vibratory excitation of the partition plates or even of the end plates.

The basic idea of the invention, according to a first aspect, is to limit the excitation in the regions where the cooling fluid arrives on the walls of the exchanger with a speed component perpendicular to the wall, this being obtained by adding stiffening elements which make it possible to limit the response of the wall to the frontal impacts of the fluid.

SUMMARY OF THE INVENTION

According to a first aspect the present invention provides a heating, ventilation and/or air-conditioning device including a thermal loop equipped with a heat exchanger, said heat exchanger consisting of a stack of orientation plates having first and second opposite longitudinal ends defining channel regions between them in which a cooling fluid travels from one said end to the other in a longitudinal direction of the orientation plates, the first and the second longitudinal ends of the orientation plates having means for directing a flow of the cooling liquid either in an axial direction of the evaporator or, by diverting it, in a longitudinal direction of the orientation plates, in a said channel region, certain orientation plates being axial-orientation plates, and certain orientation plates being partition plates which, at least at one of their ends, divert the said flow of cooling liquid into a said channel region, the heat exchanger also having end plates arranged at its two opposite axial ends, wherein at least one of the first and second longitudinal ends of at least one partition plate and/or of at least one end plate is coupled to at least one of the first and second ends of a said orientation plate by means of a damper element.

This makes it possible to reduce the vibratory amplitudes and/or to guide the fluid.

Heat exchangers generally have a rectangular shape the largest dimension of which is parallel to the direction of the non-diverted flow of the cooling fluid. The orientation plates are generally rectangular and have a length which is parallel to the direction of flow of the fluid in the channels.

The invention applies also to other geometries. That being so, in the sense of the present application, the term "axial" is understood as designating the direction of flow of the cooling fluid when it is not diverted by an orientation plate, and the term "longitudinal direction of the orientation plates" is understood as the general direction of flow of the fluid along the channel or channels, from one longitudinal end of the plates to the other.

According to a first embodiment, at least some of said orientation plates are partition plates which, at least at one end, have at least one separating wall constituting a said separation element and which have at least one rib which constitutes a said stiffening means.

According to a second embodiment, at least some orientation plates are plates called standard plates having, at their first and second ends, at least one boss provided with an aperture allowing axial passage of the cooling liquid and at least certain orientation plates are substantially flat and, at least at one end, have at least one separating wall the thickness of which is greater than twice the thickness of said standard plates, this thickness advantageously being at least equal to the thickness of an end plate, and which constitutes a said stiffening means. The plate may have a substantially constant thickness, or the separating wall may even have a thickness greater than that of the rest of the plate. It is particularly advantageous for the separating wall to be profiled in such a way as to guide the cooling fluid from said axial direction of the evaporator to said longitudinal direction of the plates, which makes it possible to reduce the noise by at least partly preventing the impact due to said speed component.

According to a third embodiment of the invention in its first aspect, the heat exchanger, for example an evaporator, consists of a stack of said standard plates and of partition plates having, at their first and second ends, at least one boss having a bearing face at least one of which has a separation element and at least one flat plate is interposed between the bearing faces of the bosses of two partition plates.

According to another embodiment of the invention in its first aspect, the evaporator consists of a stack of said standard plates, which have a first face, particularly a flat face, and a second face, particularly a flat face, from which said bosses extend, and at least some of said flat plates are interposed between the first faces of two standard plates in such a way as to define two cooling-fluid passage half-channels, one between the first face of one of said two standard plates and a first face of said flat plate and the other between the second face of said flat plate and the first face of the other of said two standard plates.

At least one said flat plate may have at least one cooling-fluid axial passage aperture at one end.

According to another embodiment of the invention in its first aspect, a said stiffening means is a stiffening plate which is interposed between a said end of two plates and which is secured to them.

The embodiments given above make it possible to deal with the problem of the noise from the partition plates, but the invention, in its first aspect, applies equally to the case of the end plates and, to this end, at least one end plate includes at least one said stiffening means.

According to one embodiment, this stiffening means is a stiffening plate integral with one end of said end plate.

According to another embodiment, said stiffening means consists of an edge of the end plate which is folded onto one face of said end plate. Alternatively, at least one transverse edge and/or a longitudinal edge projecting from the end plate may be folded against at least one lateral surface of the heat exchanger.

According to a second aspect, the invention envisages reducing the noise generated by the end plates by decoupling them from the mechanical stresses which they receive.

According to its second aspect, the invention relates to a heating, ventilation and/or air-conditioning device including a thermal loop equipped with a heat exchanger, for example an evaporator, said heat exchanger consisting of a stack of orientation plates having opposite first and second longitudinal ends and defining channel regions between them in which a cooling fluid travels from one said end to the other in a longitudinal direction of the orientation plates, the first and the second longitudinal ends of the orientation plates having means for directing a flow of the cooling fluid, either in an axial direction of the evaporator, or, by diverting it, in a longitudinal direction of the orientation plates in a said channel region, certain orientation plates being axial-orientation plates, and certain orientation plates being partition plates which, at least at one of their ends, divert said flow of fluid in a said channel region, the heat exchanger also having end plates arranged at two opposite axial ends of the evaporator, characterized in that at least one of the first and second longitudinal ends of least one partition plate and/or of at least one end plate is coupled respectively to at least a first and second end of a said orientation plate (which may or may not be a partition plate) by means of a damper element. This damper element may be a stamped boss integral with the corresponding end of the end plate. This damper element may also be a corrugated metal sheet. At least one damper element is advantageously integral with a stiffening means, in such a way as to combine the damper effect and the stiffening effect, for example that obtained by a ribbed separating wall.

According to a third aspect, the invention envisages reducing the noise generated by the end plates by reducing the acoustic coupling thereof with the outside of the heat exchanger, for example an evaporator. This is because the end plates are generally brazed along a contour and have free regions which project from the outside or the inside of this contour and which are not fixed to the rest of the evaporator. When the end plates are subjected to the impact due to the circulation of the cooling fluid, these projecting regions are stressed by the vibrations thus produced and are also set into vibration, which induces an acoustic coupling with the outside which is all the greater if the surface area in question is itself substantial.

The basic idea of the invention in its third concept is to reduce or even to eliminate the influence of these projecting regions which are not fixed to the evaporator.

To that end, the invention relates to a heating, ventilation and/or air-conditioning device including a thermal loop equipped with an evaporator, said evaporator consisting of a stack of orientation plates having opposite first and second longitudinal ends and defining channel regions between them in which a cooling fluid travels from one end to the other in a longitudinal region of the plates, the first and the second longitudinal ends of the orientation plates having means for directing a flow of cooling liquid either in a direction axial to the evaporator, or in a longitudinal direction of the plates in a said channel region, the evaporator having end plates arranged at two opposite axial ends of the evaporator and at least a part of which, particularly of the contour, is secured, particularly by brazing, to an orientation plate, characterized in that at least one end of said part, particularly of the contour, has no region which is not secured to the orientation plate.

According to a first variant, at least one outer edge of said part of the contour has a folded edge running along it which is secured to said orientation plate. According to a second variant, at least one edge of said part of the contour constitutes one edge of an aperture formed in an end plate. The surface area of said aperture is advantageously equal to 20% of the total surface area of the end plate.

BRIEF DESCRIPTION OF THE DRAWINGS

Further characteristics and advantages of the invention will emerge better upon reading the description which will follow, given by way of non-limiting example in connection with the drawings, in which:

FIG. 1 represents an orientation plate constituting a plate called a standard plate, which is known in itself;

FIG. 2*a* represents an orientation plate constituting a partition plate having a separating wall according to one embodiment of the invention;

FIG. 2*b* represents an embodiment of the invention employing a separating wall;

FIGS. 3*a* to 3*c* represent three embodiments of the invention employing what are called flat separating plates;

DESCRIPTION OF THE PREFERRED EMBODIMENT

Figure 4:
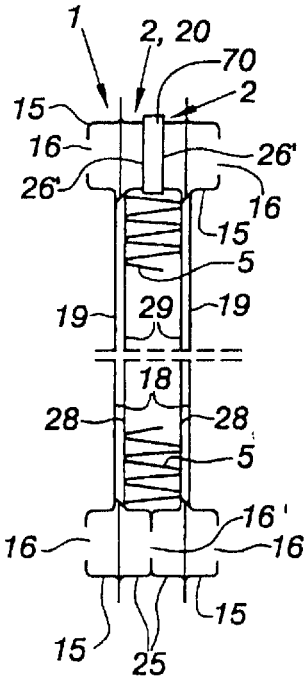
FIG. 4 represents an embodiment of the invention employing an additional mass interposed between orientation plates.

In the various figures, like reference numerals refer to like parts.

According to FIG. 1, an orientation plate, called standard plate, has, at each of its longitudinal ends, a pair of bosses 15, each of which has an aperture 16 allowing a cooling fluid to pass in an axial direction of the evaporator. These stamped bosses 15, which are directed rearwards of FIG. 1, are connected by recessed channels 14, delimited laterally by a longitudinal edge 11 of the plate 1 and separated from each other by a stamped central longitudinal rib 17. The face 18 (which is seen in FIG. 1) carries the abovementioned channels 14 while the opposite face 19, which is substantially flat in its central region, is bordered at its edges by projecting bosses 15, as FIG. 3*a* shows better.

FIG. 2*a* represents an orientation plate which constitutes a partition plate 20 and which is distinguished from the plate 1 by the presence, at least at one of the longitudinal ends, of a separating wall 26 which constitutes the bottom of a stamped boss 25 and which prevents the cooling fluid passing axially, and which constrains it to be redirected in a longitudinal direction of the plate in channel regions 24.

In other words, a heat exchanger such as an evaporator consists of a stack of orientation plates some of which are axial-orientation plates (or standard plates) and some of which are partition plates which, at least at one of their ends, divert the axial flow of the cooling liquid so as to supply the channels. The axial ends of the evaporator are equipped with end plates.

In order to reduce the noise generated by the axial impact of the cooling fluid on the separating walls 26, they, according to the invention, are stiffened by means of ribs 26' which are stamped at the same time as the partition plate 20 (or which are molded in plastic when the plates of the evaporator are of plastic).

By convention, a partition plate will be referenced 2 if it has a non-ribbed separating wall 26, in accordance with the prior art. If it has a separating wall 26 provided with ribs 26', it will be referenced 20.

FIG. 2*b* shows a stack of orientation plates called standard plates 1 and of partition plates 20. This stack of plates is produced in a way which is known in itself and defines, on the one hand, two feed channels 3 and 3' situated at the longitudinal ends of the plates and oriented in an axial direction of the evaporator (arrow F), and, on the other hand, channel regions 4 oriented in a longitudinal direction of the plates (arrow F') between a face 18 of a plate 1 and a face 28 of a plate 2, that is to say that each longitudinal channel 4 of the plates consists of two half-channels facing each other, 14 and 28. The bosses 15 and 25 are mounted head-to-tail and between them is trapped a corrugated sheet 5 generally called "fins" which serves in the conventional way to perform the thermal exchanges of the evaporator.

In the context of the invention, the bosses 25 of the plates 20 have separating walls 26 provided with ribs 26'.

The ribs 26', represented in FIG. 2*a*, have a lattice shape; this shape is given only by way of example, any shape stamped on the bottom 26 of the bosses 25 being capable of carrying out the same function.

According to one embodiment represented in FIG. 2*b*, the face 29 of a first partition plate 20 is assembled against the face 19 of a second partition plate 20 in such a way that the recess formed by the rib 26' of the first partition plate is in communication with the recess formed by the rib 26' of the second partition plate. In this embodiment example, the change of direction of the flow is carried out with the aid of two partition plates.

According to another embodiment example (not represented), the face 29 of the partition plate 20 including ribs 26' is interposed between the face 19 of a standard orientation plate 1 and the face 18 of another standard orientation plate 1. In this embodiment, the change of direction of the flow is carried out with the aid of a single partition plate 20.

Another means of reducing the noise is to interpose thicker plates or plates exhibiting overthicknesses in the region of the closed end.

FIG. 3*a* represents an embodiment of the invention in which the evaporator includes plates called standard plates 1, stacked alternately in one direction and the other, that is to say that the bosses 15 are situated alternately on the left side and on the right side of the plate. Fins 51 and 52 are arranged between the faces 19 of two adjacent plates 1 the bosses 15 of which face each other with their apertures 16 being aligned. Between the faces 18 of adjacent plates 1 one or more thick partition plates 6 are arranged, which are substantially flat, which are closed at one of their longitudinal ends 60 and which exhibit an aperture 61 at their other end. These plates 6 are thick plates which have a thickness e at least twice the thickness (a few tenths of mm) of the sheet metal constituting the plates 1 and which is advantageously greater than the thickness e' of an end plate, which is about 1 mm. The plates 6 are inserted between two adjacent orientation plates, then brazed to them.

As FIG. 3*a* shows, the assembly defines two half-channels 7 and 7' separated in the region of the axial channel 3 and which communicate with each other via the aperture 61, in the region of the axial channel 3'.

In the embodiment of FIG. 3*b*, the plates 1 and 2 (or else 20) are stacked as represented and a thick flat plate 65, closed at one longitudinal end and open via an aperture 66 at its other longitudinal end, is brazed between the bosses 25 of two partition plates 2 (or 20). This thick plate 65 constitutes a stiffener element which reduces the acoustic emission due to the impact on the bulkhead 26 of the cooling liquid originating from the channel 3 in the direction of the arrow F. A corrugated metal sheet 53 is arranged between one face 29 of a plate 2 and one face of the plate 65 and another corrugated metal sheet 54 is arranged between the other face of the sheet 65 and the face 29 of the plate 2.

FIG. 3*c* represents an embodiment which is distinguished from FIG. 3*a* by the fact that the plate 6 has an overthickness 67 at its longitudinal end in the region of the axial channel 3. According to one embodiment represented in FIG. 3*c*, the overthickness 67 exhibits a convex profile 68, which is able to facilitate the redirecting of the axial flow towards the channels 7 and 7', preventing the fluid striking the plate 6 perpendicularly.

According to a second embodiment (not represented), this overthickness 67 advantageously exhibits a concave profile so as to channel and to guide the fluid towards the channel 7.

FIG. 4 represents a stack of plates 1 and 2 which is produced in the same way as in the case of FIG. 3*c*, but in which the plate 65 is replaced by a thick plate 70 which extends over the width of the corresponding longitudinal end. The bosses 25 of the plates 2 have a lower height at this end than at the other end, so as to take account of the thickness of this plate 70 (for example 1 mm or more).

The plate 6, the overthickness 67 as well as the plate 70 are molded either in metal such as steel or aluminum or in a flexible material such as polymer or rubber.

Figure 5D:
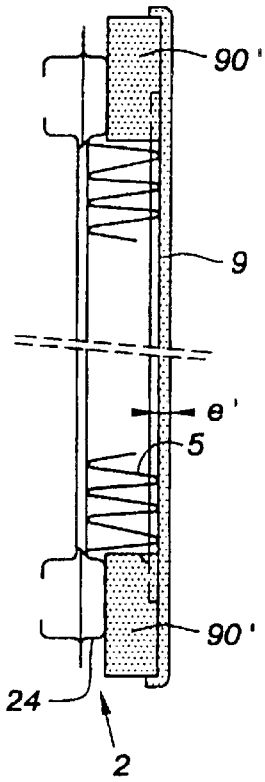
FIGS. 5*a* to 5*d* respectively represent a detail of one end of an evaporator according to the prior art, and three embodiments employing end plates coupled to additional masses.
Figures 5A, 5B, 5C, 6A, 6B:
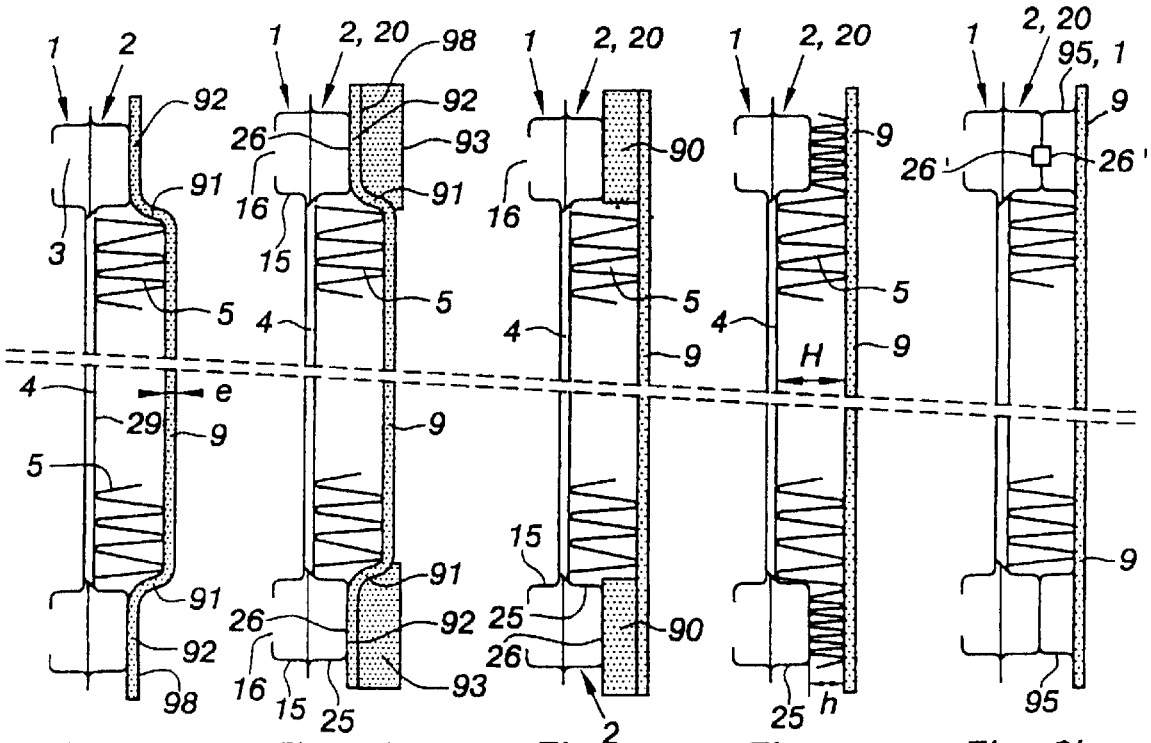
Fig. 5a PRIOR ART Fig. 5b Fig. 5c Fig. 6a Fig. 6b
FIGS. 6*a* and 6*b* represent two embodiments allowing decoupling of the end plates with respect to the rest of the evaporator.

FIG. 5*a* represents the end of an evaporator according to the prior art. An end plate 9 has stepped features 91 at each of its longitudinal ends which are extended by flat regions 92 which are brazed to the bosses 25 of partition plates 2, a corrugated metal sheet 5 being trapped between the end plate 9 and the face 29 of the plate 2 for the thermal exchanges between the evaporator and its environment.

According to the invention, and as represented in FIG. 5*b*, a small plate 93 is brazed to the outer faces 98 of the flat regions 92 so as to constitute a stiffener element able to reduce the noise generated by the axial impact of the fluid on the solid faces 26 of the plate 2 (or 20).

In the variant of FIG. 5*c*, the end plate 9 is flat and the thick end plates 90' are arranged between them and the bosses 25 of the partition plate 2 (or 20).

FIG. 5*d* is distinguished from FIG. 5*c* by the fact that the small end plates 90 are replaced by small plates 90' of greater thickness, while the bosses 25 for their part are replaced by bosses 24 of lower height, while keeping the same space available for the corrugated metal sheet 5.

Moreover, the protruding transverse 96 and/or longitudinal 97 ends of the end plate 9 are folded and brazed along additional masses and/or fins.

FIG. 6*a* illustrates a second concept according to the invention. A flat end plate 9 is brazed to fins 5 exhibiting, at each of their longitudinal ends, a region of height h which extends over a length corresponding approximately to the transverse dimension of the bosses 25 and, in the central part, a region of height H which extends over a length corresponding approximately to the length of the channels 4. This allows a decoupling by damping between the plate 9 and the bosses 25 of the orientation plate 2 (or 20).

According to FIG. 6*b*, the plate 9 is decoupled by bosses 95 which provide damping of the transmission of the vibrations from the orientation plate 2 (or 20).

The bosses 95 may consist of an orientation plate 1, 2 or 20 which is interposed between a partition plate 2 (or 20) and the end plate 9, the plate 9 being brazed against the face 28 of the orientation plate 1, 2 or 20. In this case, the bosses 25 of the partition plate are brazed against the bosses 25 of the orientation plate 1, 2 or 20. Advantageously, two partition plates 20 including ribs 26' are assembled in such a way that the recess formed by the rib 26' of one partition plate is in communication with the recess formed by the rib 26' of the other partition plate.

This decoupling by damping reduces the transmission of the noise to the end plates 9 and thus the acoustic emission produced by the plates 9.

Figures 7A, 7B, 7C, 7D:
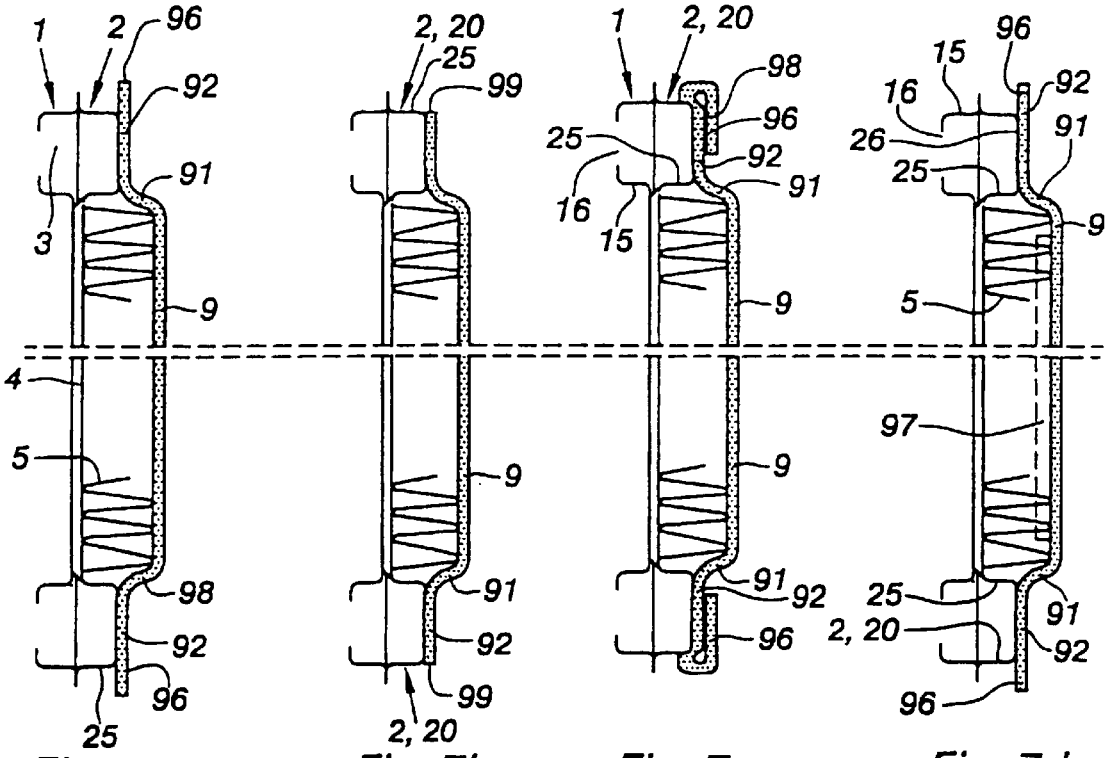
Fig. 7a Fig. 7b Fig. 7c Fig. 7d PRIOR ART
FIGS. 7*a* to 7*d* respectively represent a detail of one end of an evaporator according to the prior art, and three embodiments aiming to reduce the noise generated by a said end plate, according to three embodiments of the invention.

As FIG. 7*a* shows, the flat end regions 92 in which the end plate 9 is brazed to the partition plate 2 exhibit projecting parts or rims 96 which protrude outwards beyond the boss 25 of the partition plate 2. According to the embodiment of FIG. 7*b*, this rim 96 is eliminated so that the plate 9 exhibits edges 99 which do not extend beyond the contours over which the plate 9 is secured to the bosses 25, or else, preferably, as represented in FIG. 7*c*, it is folded onto the face 98 of the flat region 92. The end plate 9 also represented in FIG. 8*a* may also exhibit projecting longitudinal regions 97 which, according to the invention, are advantageously folded over and brazed to a lateral face of the evaporator. The central region of the end plate 9, which is not secured to the evaporator, is liable to constitute an acoustic-coupling region of significant surface area. According to the invention, it is proposed to eliminate it by forming a cut-out 108 of rectangular contour 100, 101. According to another embodiment, the end plate 9, represented in FIG. 8*b* includes a central cut-out 108 and its projecting transverse 96 and longitudinal 97 ends have been eliminated.

Figures 8A, 8B, 8C:
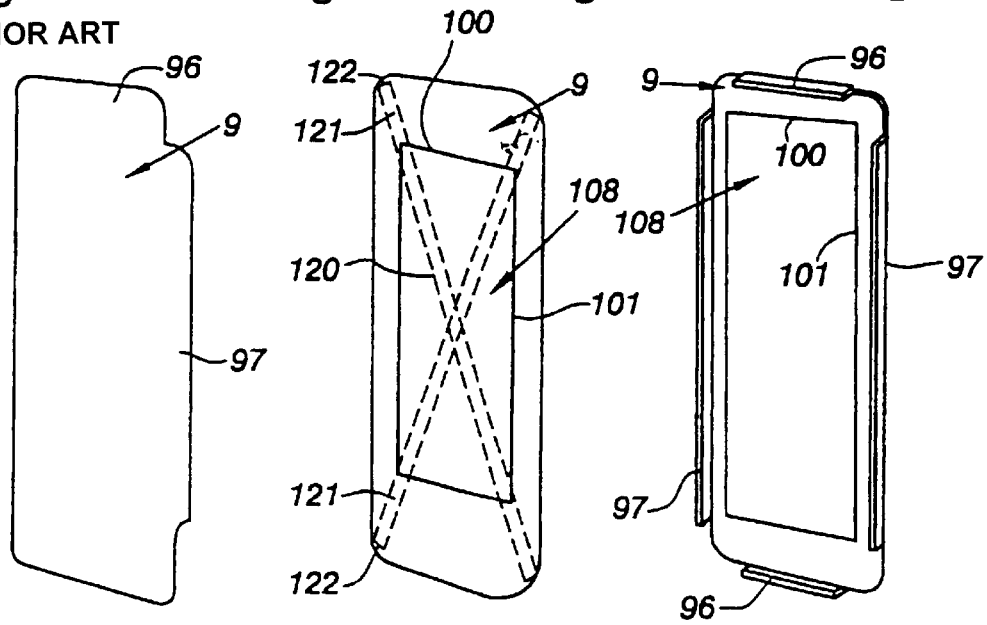
FIGS. 8*a* to 8*c* respectively represent an end plate according to the prior art and two embodiments of an end plate according to the invention, making it possible to reduce the noise emitted by said plates.

The end plate 9 which is represented in FIG. 8*c*, for example, no longer exhibits regions which are not secured either outwards, since the projecting regions 96 and 97 have been folded over and brazed to the bosses 25 of the partition plate 2, or inwards since the cut-out 108 has been formed. It will be noted that, whereas the embodiment of FIG. 8*c* provides for folding-down and brazing of the projecting regions 96 onto the boss 25, it is also possible to carry out this folding onto the plate 9, as in FIG. 7*c*.

Advantageously, the cut-out surface 108 represents more than 20% of the surface area of a face of an orientation plate (or of a conventional end plate). This is because, in order to reduce the vibratory excitation of the end plates, it is necessary to take away the maximum amount of material of the plate. The remaining part of the plate protects the fins during the brazing process. The remaining part of the plate, represented in FIG. 8*b*, has the shape of a frame, but this shape, however, is not in any way limiting; the remaining part possibly being formed by one or more strips which intersect (as represented in dashed line at 120 in FIG. 8*b*). These strips are secured at 121, for example up to their edges 122, to an orientation plate.

The embodiments described above make it possible to limit the vibratory excitation of the partition plates and/or of the end plates by taking account of the phenomena of vibratory excitation which are due to the impact of the cooling fluid on the walls of the exchanger with a speed component perpendicular to the wall.

Such a plate-type exchanger can thus fulfil two uses:

either as evaporator for motor-vehicle air-conditioning systems, or as a gas-gas exchanger or evaporator for a combined motor-vehicle air-conditioning and additional thermodynamic heating system.

It will be noted that the embodiments described can be implemented by a stamping technique which does not carry any additional cost by comparison with the solutions currently employed.

What is claimed is:

1. A heating, ventilation and/or air-conditioning device including a thermal loop equipped with a heat exchanger, the heat exchanger comprising:

a stack of orientation plates having first and second opposite longitudinal ends defining channel regions between them in which a cooling liquid travels from one said end to the other in a longitudinal direction of the orientation plates, the first and the second longitudinal ends of the orientation plates having means for directing a flow of the cooling liquid either in an axial direction of the heat exchanger or, by diverting it, in the longitudinal direction of the orientation plates, in said channel region, certain orientation plates being axial-orientation plates, and certain orientation plates being partition plates which, at least at one of their ends, divert the flow of the cooling liquid into said channel region, the heat exchanger also having end plates arranged at its two opposite axial ends, wherein a one of the longitudinal ends of at least one of the orientation plates is coupled by means of at least one damper element to a corresponding end of at least one other of the orientation plates and/or at least one of the end plates, wherein at least one said damper element is integral with a stiffening means.

2. The device of claim 1, wherein at least one stiffening means is a ribbed separating wall for diverting the flow of cooling liquid.

3. The device of claim 2, wherein the ribbed separating wall comprises a plurality of ribs disposed on the separating wall in a lattice shape.

4. The device of claim 1, wherein at least one said damper element is a stiffening plate interposed between the end plate and the longitudinal end of one of the orientation plates that is coupled to the corresponding end of another of the orientation plates and/or at least one of the end plates.

5. The device of claim 4, wherein the stiffening plate further comprises an axially extending boss extending from the stiffening plate to the end plate.

6. The device of claim 1, wherein the orientation plates are coupled together at a plurality of adjacent separating walls and a plurality of ribs are provided on the separating walls, and wherein at least one said damper element is a stiffening plate interposed between one of the end plates and a closed end where said flow of the cooling liquid in the axial direction is prevented by a one of the partition plates or by the end plate.

7. A heating, ventilation and/or air-conditioning device with a heat exchanger, the heat exchanger comprising:

a pair of end plates defining axial ends of the heat exchanger; and a plurality of stacked plates comprising (1) at least one standard plate having (a) an aperture formed in a bottom of at least one axially extending boss, the aperture configured to permit axial flow and (b) a recessed longitudinal channel configured to permit longitudinal flow, and (2) at least one partition plate having a separating wall disposed adjacent to the aperture of the at least one standard plate;

wherein at least one other separating wall couples together with at least two of the stacked plates at a closed end defined where at least one of the apertures is adjacent to the separating wall or the end plate, and wherein the heat exchanger further comprises a plurality of ribs carried by the at least one other separating wall.

8. The device of claim 7, wherein a longitudinal end of at least one of the stacked plates is coupled by a protrusion to a corresponding end of at least one other of the stacked plates and/or at least one of the end plates, the protrusion being integral with the corresponding end.

9. The device of claim 7, wherein the ribs are disposed on the separating wall in a lattice shape.

10. The device of claim 7, further comprising a stiffening plate interposed in a region of the closed end.

11. A heating, ventilation and/or air-conditioning device with a heat exchanger, the heat exchanger comprising:

a pair of end plates defining axial ends of the heat exchanger; and a plurality of stacked plates comprising (1) at least one standard plate having (a) an aperture configured to permit axial flow and (b) a recessed longitudinal channel configured to permit longitudinal flow, and (2) at least one partition plate having a separating wall disposed adjacent to the aperture of the at least one standard plate;

wherein at least one other separating wall couples together with at least two of the stacked plates at a closed end defined where at least one of the apertures is adjacent to the separating wall or the end plate, and wherein the at least one other separating wall further comprises a stiffening plate interposed between the end plate and the closed end, the end plate being coupled to the stiffening plate through an axially extending boss.

12. The device of claim 11, wherein the end plate is only coupled to the stiffening plate through the boss.

13. A heating, ventilation and/or air-conditioning device including a heat exchanger, the heat exchanger comprising:

a plurality of orientation plates comprising (1) at least one standard plate having (a) an aperture configured to permit axial flow and (b) a recessed longitudinal channel configured to permit longitudinal flow, (2) at least one partition plate having a separating wall disposed adjacent to the aperture of the at least one standard plate;

a pair of end plates arranged at opposing axial ends of the orientation plates; and at least one boss extending from a one of the end plates and configured to dampen vibration transmission from an adjacent orientation plate, wherein a one of the partition plates is adjacent to the end plate, and wherein the at least one boss comprises a one of the partition plates interposed between an adjacent partition plates and the end plate.

14. The device of claim 13, wherein the end plate is brazed against a face of the interposed orientation plate.

15. The device of claim 13, further comprising a plurality of ribs provided on both the adjacent partition plate and the interposed partition plate.

16. The device of claim 15, wherein a recess formed by the ribs of the adjacent partition plate is in communication with a recess formed by the ribs of the interposed partition plate.

* * * * *